United States Patent [19]

Leng

[11] Patent Number: 4,531,133

[45] Date of Patent: Jul. 23, 1985

[54] THERMAL RECORDING DEVICE

[75] Inventor: Svay Leng, Ebina, Japan

[73] Assignee: Fuji Xerox Co., Ltd., Kanagawa, Japan

[21] Appl. No.: 555,215

[22] Filed: Nov. 25, 1983

[30] Foreign Application Priority Data

Feb. 2, 1983 [JP] Japan ..... 58-14622

[51] Int. Cl.[3] ..... B41J 3/20

[52] U.S. Cl. ..... 346/76 PH; 358/284; 346/139 R

[58] Field of Search ..... 346/75, 154, 153.1, 346/76 R, 76 L, 76 PH, 151, 139 R; 219/216 PH; 400/120, 51–52; 358/282–284, 296–298, 75; 364/518, 514

[56] References Cited

U.S. PATENT DOCUMENTS 4,150,401 4/1979 Yamamoto et al. ..... 358/284

4,272,771 6/1981 Furukawa ..... 346/75

*Primary Examiner*—Thomas H. Tarcza

*Assistant Examiner*—A. Evans

*Attorney, Agent, or Firm*—Kinney & Lange

[57] ABSTRACT

According to the present invention, appearance of a white space line produced on record can be prevented, and such white space line is produced due to excessive travel of a recording paper in the case when recording information to be inputted is interrupted. In the present invention, for the sake of attaining such advantageous effect as mentioned above, either additional recording for 1 line is carried out on the basis of the recording information of the last recording, or additional recording for 1 line is effected on the basis of the recording information of the last recording or the recording information which was newly received during a period after the following recording information was received and before the recording paper starts travel thereof for recording in the case when a period of time from the last recording for 1 line to reception of the following recording information exceeds an expected value.

9 Claims, 8 Drawing Figures

THERMAL RECORDING DEVICE

BACKGROUND OF THE INVENTION

1. Field of the Invention

This invention relates to a thermal recording device of direct heat-sensitive type or thermal transfer type, and particularly to a thermal recording device by which a possibility of appearance of a white space line which is produced on a recording medium in the case when waiting time for information to be inputted to the recording device is comparatively long can be eliminated.

2. Description of the Prior Art

FIG. 1 is a schematic side view showing a conventional thermal recording device which has heretofore been utilized in general wherein a thermal recording paper 1 is held between a drive roll 2 and a pinch roll 3, and the recording paper 1 is supplied from a supply roll 4 by the rotation of these rolls in the direction of the arrow, so that the recording paper travels between a recording head 5 and a back roll 6 opposed thereto. As is well known, the recording head 5 is provided with a number of heat generating elements, and every 1 line thermal recording is executed by such a manner that electrical energy corresponding to 1 line recording information to be recorded is supplied to individual heat generating elements.

The thermal recording paper 1 is further wound up by means of a winding roll 7.

In such thermal recording device as mentioned above, however, the thermal recording paper 1 is conveyed in a condition where it is stretched by means of the drive roll 2 and the pinch roll 3 in ordinary recording state.

For this reason, the thermal recording paper 1 used to be conveyed under such conditions where the recording paper has been stretched by a certain extent. Moreover, in this case, there is a certain amount of strain on rubber portion around the outer boundary of the drive roll 2 in the circumferential direction thereof. In normal operating conditions where printing is successively executed for the respective lines with an interval within a predetermined period, there is no substantial obstacle in respect of the above extent of the recording paper stretched as well as the amount of strain around the circumference of the drive roll, because they have constant values, respectively.

However, when waiting time for inputting printing information is prolonged so that stop time in rotation of the drive roll 2 is also prolonged, the rubber portion of the drive roll 2 tends to return to its equilibrium state so that the circumferential rubber portion is displaced towards the direction for drawing out the recording paper 1, whilst the recording paper 1 in the stretched state tends to return to its normal state.

In this case, the thermal recording paper 1 is firmly held and clamped in abutting portion between the drive roll 2 and the pinch roll 3 in general. Thus, the thermal recording paper 1 shrinks towards the direction of the abutting portion between the drive roll 2 and the pinch roll 3 so that a portion of the thermal recording paper 1 existing in between the thermal head 5 and the back roll 6 moves along its travelling direction.

As a result, as is clearly understood from FIG. 2, a pitch a between lines in travelling direction of record corresponding to the aforesaid portion of the recording paper becomes larger than a normal pitch b to produce a white space line c, so that it brings about a disadvantage of deterioration in picture quality. In FIG. 2, mark o designates a recording dot produced by the thermal head 5, and a dot column #1 is recorded in accordance with first line buffer information, whilst a dot column #2 is recorded in accordance with memory information of second line buffer.

SUMMARY OF THE INVENTION

It is an object of the present invention to provide a thermal recording device which is capable of eliminating the disadvantage as mentioned above and by which no white space line is not produced on a recording medium so that deterioration in picture quality can be prevented, even if waiting time for input information to be recorded is prolonged so that, as mentioned above, a thermal recording paper shrinks by an extent corresponding to that which had already been stretched, or strain on a rubber portion around the circumference of a drive roller returns to its original state.

In order to attain the above object, the present invention is characterized in that same printing operations are carried out successively in twice on the basis of either printing information for 1 line which has lastly been recorded on a thermal recording paper, or printing information for 1 line which was first received after the lapse of waiting time in the case where a pitch between lines on the recording paper in the travelling direction thereof becomes wider than a predetermined width because of shrinkage of the thermal recording paper and/or restoration of strain on a rubber portion around the circumference of a drive roller.

DETAILED DESCRIPTION OF THE INVENTION

Figure 1:
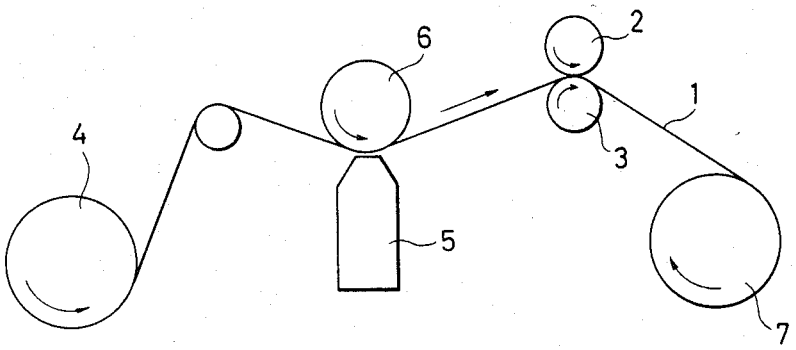
FIG. 1 PRIOR ART
FIG. 1 is a schematic side view showing a conventional thermal recording device.
Figure 5:
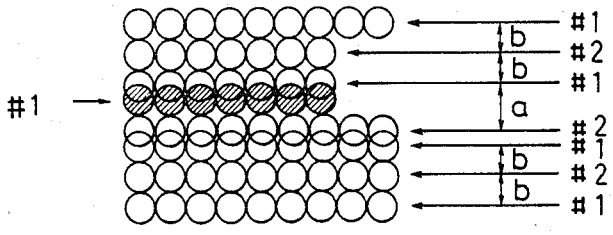
FIG. 5 is a view illustrating a recorded state in accordance with the above example of the present invention.
Figure 3:
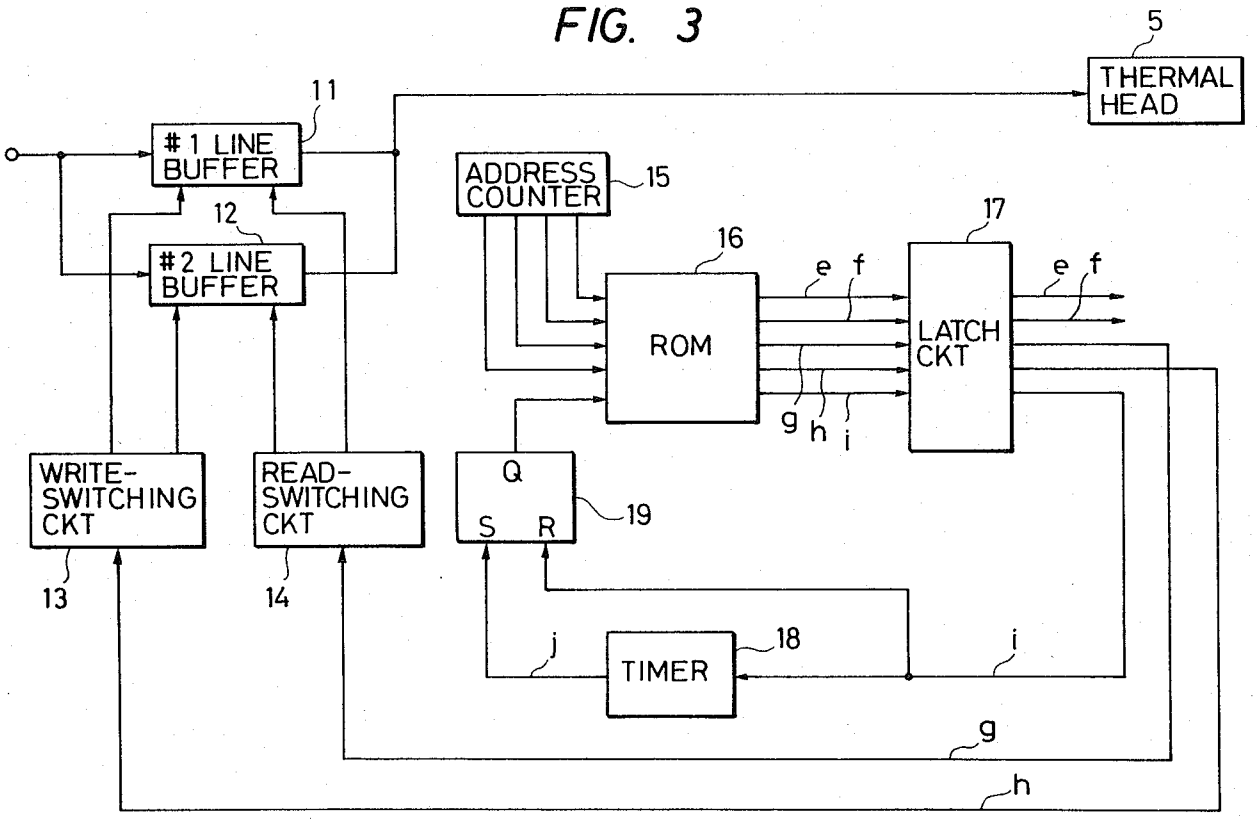
FIG. 3 is a block diagram illustrating an example of the present invention.
Figure 4:
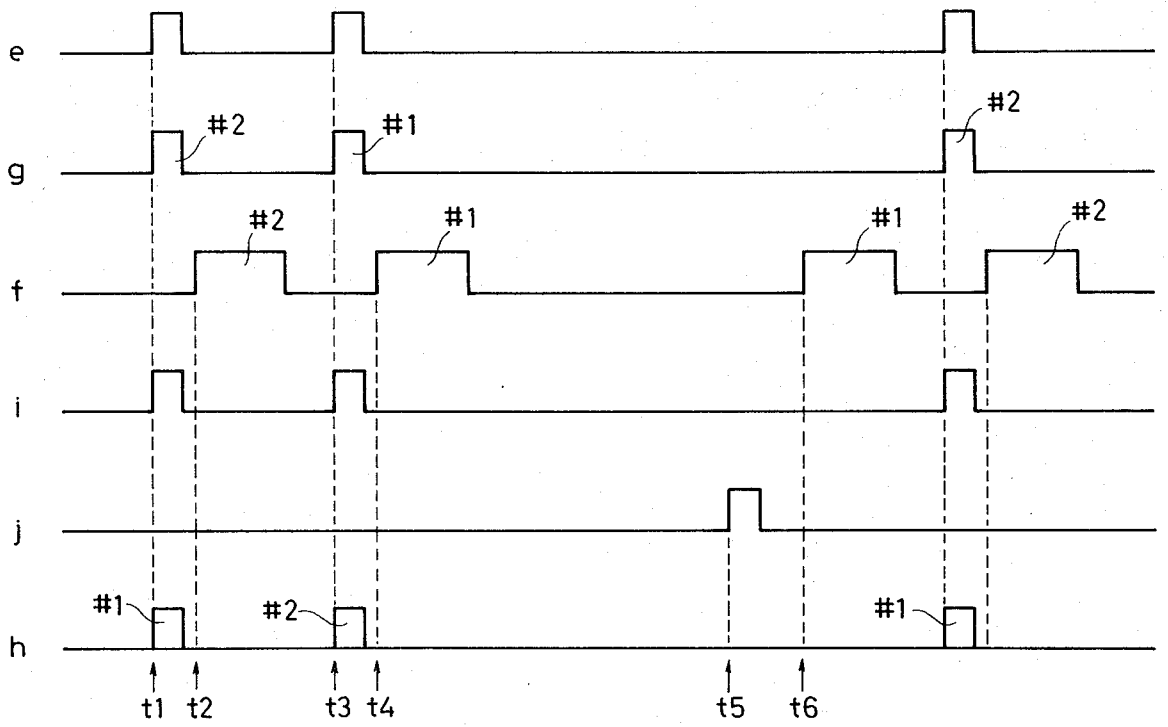
FIG. 4 is a timing chart of FIG. 3.

The examples of the present invention will be described hereinbelow by referring to the accompanying drawings wherein FIG. 3 is a block diagram showing an example of the invention, FIG. 4 is a timing chart of FIG. 3, and FIG. 5 is a view illustrating a recorded state in accordance with the above example of the invention. In FIGS. 3, 4 and 5, first and second line buffers 11 and 12 function to tentatively store data signal for 1 line which is outputted from, for example, a computer, a write-switching circuit 13 effects switching in write of the first line buffer 11 and the second line buffer 12, and a read-switching circuit 14 effects switching in read of the first line buffer 11 and the second line buffer 12. A recording head 5 is thermal recording type as shown in FIG. 1. Output signal of the first line buffer 11 or the second line buffer 12 is alternately supplied to the recording head 5 on the basis of control by means of the read-switching circuit 14. The recording head 5 is provided with a buffer circuit (not shown). Such thermal recording device as described above is well known by those skilled in the art.

An address counter 15 specifies address of a ROM (read-only memory) 16 to output prescribed signals, i.e., motor driving signal e of the drive roll 2 shown in FIG. 1, printing signal f, data transferring signal g to the above-mentioned recording head 5, signal h for selecting write or read, timer resetting signal i, and signal for printing again lastly recorded line at a given timing.

A latch circuit 17 retains the respective output signals from the ROM 16. A timer 18 counts clock pulses from a clock generator (not shown) to supply setting signal j to a flip-flop 19 in the case when an expected value or more is counted.

The flip-flop 19 is set at the time when the setting signal j is supplied from the timer 18 and outputs address signal corresponding to "signal for printing again lastly recorded line" set in the ROM 16.

Circuit operation of such thermal recording device having the construction as mentioned above will be described hereinbelow with reference to a timing chart of FIG. 4.

First, address signal corresponding to the write or read selecting signal set in the ROM 16 is outputted from the address counter 15 and supplied to the ROM 16, whereby the write or read selecting signal h is outputted from the ROM 16 and supplied to the latch circuit 17 to retain the signal therein.

At time $t_1$, the write or read selecting signal h is outputted from the latch circuit 17 and supplied to the write-switching circuit 13, whereby write signal outputted from the write-switching circuit 13 is switched, for example, from the second line buffer 12 to the first line buffer 11, so that write is effected in respect of the first line buffer 11.

At the same time, address signals corresponding to motor driving signal, data transferring signal, and timer resetting signal set in the ROM 16 are outputted from the address counter 15 and supplied to the ROM 16.

Thus, the motor driving signal e, the data transferring signal g, and the timer resetting signal i are outputted respectively from the ROM and supplied to the latch circuit 17 to retain the signals therein. At time $t_1$, the motor driving signal e outputted from the latch circuit 17 is supplied to the drive roll 2 shown in FIG. 1 to drive the roll, whilst at time $t_1$, the data transferring signal g is supplied to the read-switching circuit 14.

Hence, the read signal outputted from the read-switching circuit 14 is switched from the first line buffer 11 to the second line buffer 12, whereby read-out of the second line buffer 12 is selected. The resulting information for 1 line read out of the second line buffer 12 is stored in the buffer circuit (not shown) provided in the above thermal head 5.

Likewise, at time $t_1$, either time resetting signal i outputted from the latch circuit 17 is supplied to the timer 18 to return the timer count to zero. As a result, output of the setting signal j from the timer 18 is prevented, while the said signal i is supplied to the flip-flop 19 to reset the flip-flop 19. Accordingly, Q terminal output of the flip-flop 19 remains trailing, in other words, the Q terminal output is in low level.

From the address counter 15, address signal corresponding to the printing signal set in the ROM is further outputted and supplied to the ROM 16, whereby the printing signal f is outputted from the ROM and supplied to the latch circuit 17 to retain the signal therein. On the other hand, at time $t_2$, the thermal recording head 5 is driven by the printing signal f outputted from the latch circuit 17.

As described above, printing for 1 line is carried out in respect of the first line.

Next, address signal corresponding to the write or read selecting signal set in the ROM 16 is outputted again from the address counter 15 and supplied to the ROM 16, whereby the write or read selecting signal h is outputted similarly from the ROM 16 as mentioned above.

The write or read selecting signal h outputted from the ROM 16 is supplied to the latch circuit 17 and this signal h is outputted at time $t_3$ from the latch circuit 17 so that the signal outputted is supplied to the write-switching circuit 13. Thus, the write signal outputted from the write-switching circuit 13 is switched from the first line buffer 11 to the second line buffer 12, thereby to carry out write in respect of the second line buffer 12.

At the same time, address signals corresponding to motor driving signal , data transferring signal, and timer resetting signal set in the ROM 16 are similarly outputted from the address counter 15 as mentioned above, and these address signals are supplied to the ROM 16. As a result, the motor driving signal e, the data transferring signal g, and the timer resetting signal i are respectively outputted from the ROM 16 and they are supplied to the latch circuit 17.

The aforesaid motor driving signal e outputted from the latch circuit 17 is supplied at time $t_3$ to the above-mentioned drive roll 2 to drive it, whilst the data transferring signal q is supplied at time $t_3$ to the read-switching circuit 14.

Hence, read signal outputted from the read-switching circuit 14 is switched from the second line buffer 12 to the first line buffer 11 so that read-out of picture signal in the first line buffer is selected. The information for 1 line thus read out of the first line buffer 11 is stored in the buffer circuit provided in the aforesaid thermal head 5.

Likewise, either of timer resetting signals i outputted from the latch circuit 7 is supplied to the timer 18 at time $t_3$ to return the timer count to zero. As a result, it is prevented to output the setting signal j from the timer 18, while the said signal i is supplied to the flip-flop 19 to reset it. Accordingly, output at Q terminal of the flip-flop 19 also remains trailing in this case, too.

From the address counter 15, address signal corresponding to the printing signal set in the ROM 16 is further outputted and supplied to the ROM 16, whereby the printing signal f is outputted from the ROM 16 and supplied to the latch circuit 17 to retain the signal therein. On the other hand, at time $t_4$, the thermal recording head 5 is driven by the printing signal f outputted from the latch circuit 17.

As described above, printing for 1 line is effected in respect of the second line.

In normal state, printing of the first and second lines is alternately carried out by repeating the operations as mentioned above.

However, in the case when waiting time for information is over an expected period of time, more specifically, when leading edge of the timer resetting signal i illustrated in FIG. 4 is behind the expected time which has been preset, the timer 18 counts up to output the setting signal j therefrom at time $t_5$ and the signal j is supplied to the flip-flop 19.

When the setting signal j issupplied, the flip-flop 19 is set so that output at Q terminal rises to output address signal corresponding to the "signal for printing again lastly recorded line" set in the ROM 16. The above address signal is supplied to the ROM 16 and from which the printing signal f is again supplied to the latch circuit 17, so that the printing signal f is outputted from the latch circuit 17 at time $t_6$.

Figure 2:
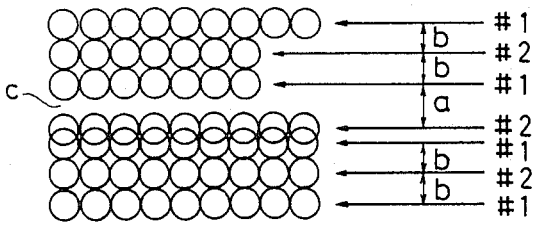
FIG. 2 PRIOR ART
FIG. 2 is a view illustrating a white space line produced on a record in the case when waiting time for printing information to be inputted is over a predetermined period of time in a conventional thermal recording device.

In accordance with the manner as mentioned above, the same printing as the lastly recorded first line is again additionally carried out. This additional printing is represented by the shaded mark o column in FIG. 5. As is easily understood from the comparison with FIG. 2, the additional printing is effected upon a part of the white space line (print omitted) shown in FIG. 2. Accordingly, it becomes possible to prevent production of the white space line on its record as clearly shown in FIG. 5.

Thereafter, the above-mentioned operations at normal state are effected in the order of the second line and the first line to perform printing.

Although it is arranged in the above case that the printing signal f of the lastly recorded line is outputted from the latch circuit 17 to carry out printing after waiting time for information was over an expected period of time, i.e., after the thermal recording paper 1 stopped completely, in other words, after shrinking phenomenon of the recording paper terminated completely (usually, after the elapse of about 500 milliseconds), the present invention is not necessarily limited to the above arrangement. Namely, for example, such arrangements that the same printing with the preceding one is carried out after the following data signal was received and that printing operations are repeated twice in accordance with the following data signal received may also be made.

Figure 6:
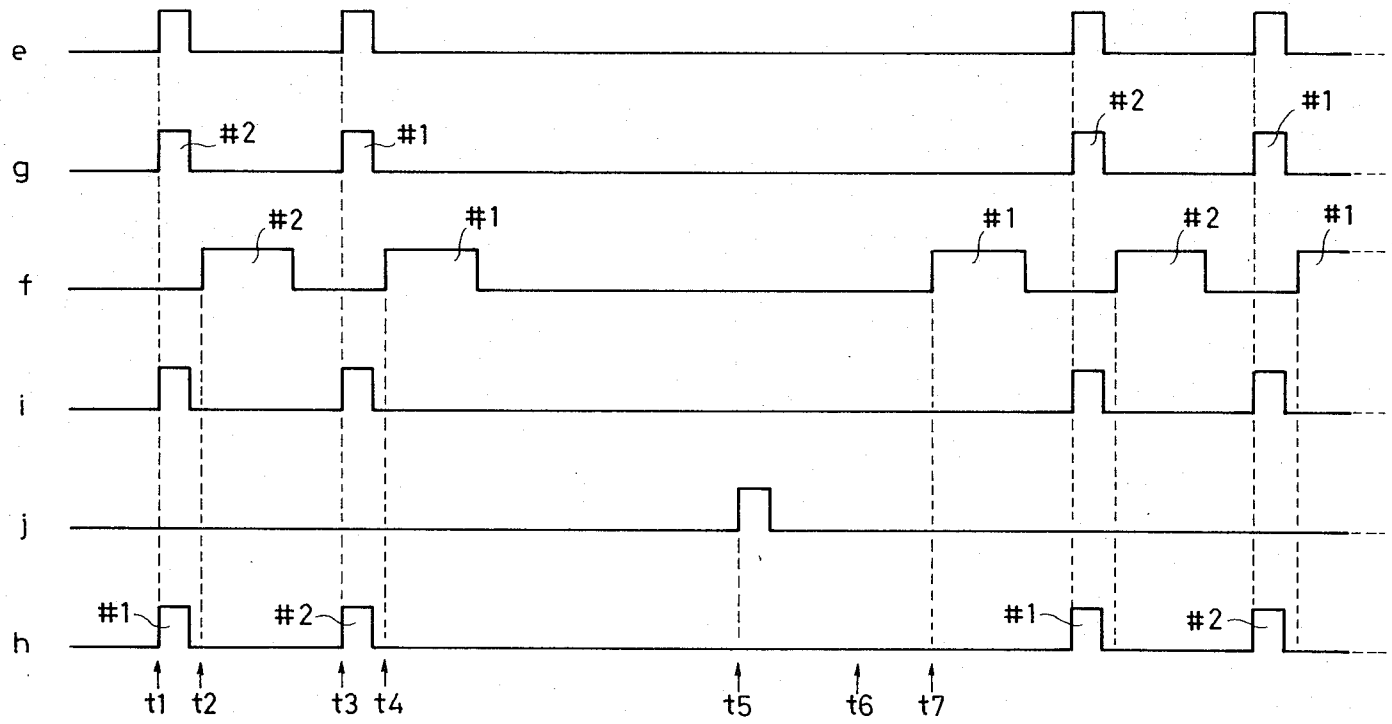
FIG. 6 is a timing chart showing timing of printing which is effected again in accordance with another example of the present invention.

FIG. 6 is a timing chart for explaining the case where the same printing with the preceding one is effected when the following data signal was received wherein the timer 18 counts up to output the setting signal j at time $t_5$ in the case when the timer resetting signal i of the timer 18 was not supplied even after the elapse of an expected time.

The setting signal j is supplied to the flip-flop 19 to set it, whereby output at Q terminal rises to output address signal corresponding to the "signal for printing again the same printing with the preceding one after the following data signal was received" which has been set in the ROM 16.

The aforesaid address signal is supplied to the ROM 16 and from which the printing signal f is again outputted. The printing signal f is supplied to the latch circuit 17 and from which the signal is outputted at time $t_7$ after the following data signal was received at time $t_6$, whereby information for 1 line is printed again in respect of the first line buffer 11.

Thereafter, printing is carried out in accordance with the above-mentioned normal operations.

In brief, the following two manners have been described hereinbefore in respect of the case where waiting time for information was over expected period of time:

(1) The same printing with the preceding one is again carried out irrespective of the fact whether the following data signal was received or not.

(2) The same printing as the preceding one is again carried out after the following data signal was received.

Furthermore, procudures for operation steps will be described hereinbelow with respect to cases of the above manners (1) and (2) by referring to computer program flow charts illustrated in FIGS. 7 and 8.

First, in the manner (1), the operation in the respective steps of FIG. 7 will be described with respect to the case where the thermal head 5 is provided with a buffer circuit.

Step $S_1$ . . . It is decided whether the timer 18 counts up or not. In case of counting up, the operation proceeds to Step $S_9$, whilst it proceeds to Step $S_2$ in case of not counting up.

Step $S_2$ . . . It is decided whether the following data signal was received or not. In case of receiving, the operation proceeds to Step $S_3$, whilst it returns again to Step $S_1$, and then, the operation circulates through Steps $S_1$ and $S_2$ in case of not receiving.

Step $S_3$ . . . It is decided whether flag is "1" or not. In case where the flag is "1", the operation proceeds to Step $S_7$, whilst it proceeds to Step $S_4$ in case where the flag is not "1". In this case, the expression "the flag is "1"" means that there was the recording for 1 line based on information of the second line buffer 12 immediately before the present printing, while the expression "the flag is not "1"" means that there was the recording for 1 line based on memory informatibn of the first line buffer 11 immediately before the present printing.

Step $S_4$ . . . The first line buffer 11 is written in, the second line buffer 12 is read out, and the recording paper is moved.

Step $S_5$ . . . The flag is set, and the timer 18 is reset.

Step $S_6$ . . . Printing based on the data read out from the first or second line buffer is executed.

Step $S_7$ . . . As a result of the decision in Step $S_3$, the operation proceeds to this step in case where the flag is "1" so that the second line buffer 12 is written in, the first line buffer 11 is read out, and the recording paper is moved.

Step $S_8$ . . . The flag is reset, and the timer 18 is reset.

As described above, operation circulates alternately through the Steps $S_1 \rightarrow S_2 \rightarrow S_3 \rightarrow S_4 \rightarrow S_5 \rightarrow S_6 \rightarrow S_1$, or the steps $S_1 \rightarrow S_2$ $S_3 \rightarrow S_7 \rightarrow S_8 \rightarrow S_6 \rightarrow S_1$ in accorddance with data signal received, whereby printing each 1 line is successively effected.

In the case when waiting time for information was over expected period of time, the operation executes the following Steps $S_9$ and $S_{10}$.

Step $S_9$ . . . In case when counting up of the timer 18 is decided in Step $S_1$, the same printing with the preceding one is immediately executed again.

Step $S_{10}$ . . . It is decided whether data signal was received or not. In case of not receiving, the operation is stand-by until the data signal is received. When the data signal is received, the operation proceeds to Step $S_3$.

Next, in the manner (2), the operation in the respective steps of FIG. 8 will be described with respect to the case where, for example, the thermal head 5 is not provided with a buffer circuit.

Figure 7:
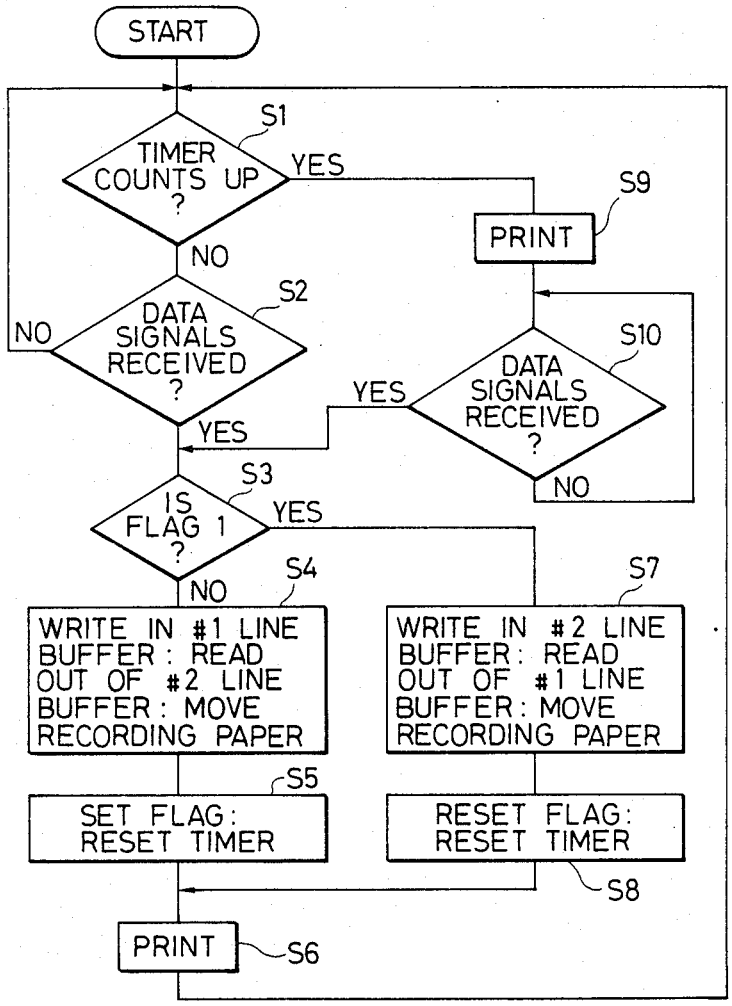
FIG. 7 is a flow chart of FIG. 3.

Contents of treatment in Steps $S_1$14 $S_8$ are quite same with those of FIG. 7.

In the case where waiting time for information is normal, similar operations to those mentioned above in respect of FIG. 7 are repeated in accordance with Steps $S_1$–$S_8$. On the other hand, in abnormal case, the timer 18 counts up so that the procedure for treatment proceeds from Step $S_1$ to Step $S_{11}$.

Step $S_{11}$ . . . It is decided whether data signal is received or not. In case of not receiving, the operation is stand-by until the signal is received. When the data signal is received, the operation proceeds to Step $S_{12}$.

Step $S_{12}$ . . . It is decided whether flag is "1" or not. In case where the flag is "1", the operation proceeds to Step $S_{13}$, whilst it proceeds to Step $S_{14}$ in case where the flag is not "1".

Step $S_{13}$ . . . In case where the flag is "1", since there was the printing based on information of the second line buffer 12 immediately before the present printing, the second line buffer 12 is again read out.

Step $S_{14}$ . . . In case where the flag is not "1", since there was the printing based on information of the first line buffer 11 immediately before the present printing, the first line buffer 11 is again read out.

Step $S_{15}$ . . . Printing based on information for 1 line of the line buffer read out is executed. After the execution of printing, the operation proceeds to Step $S_3$.

Figure 8:
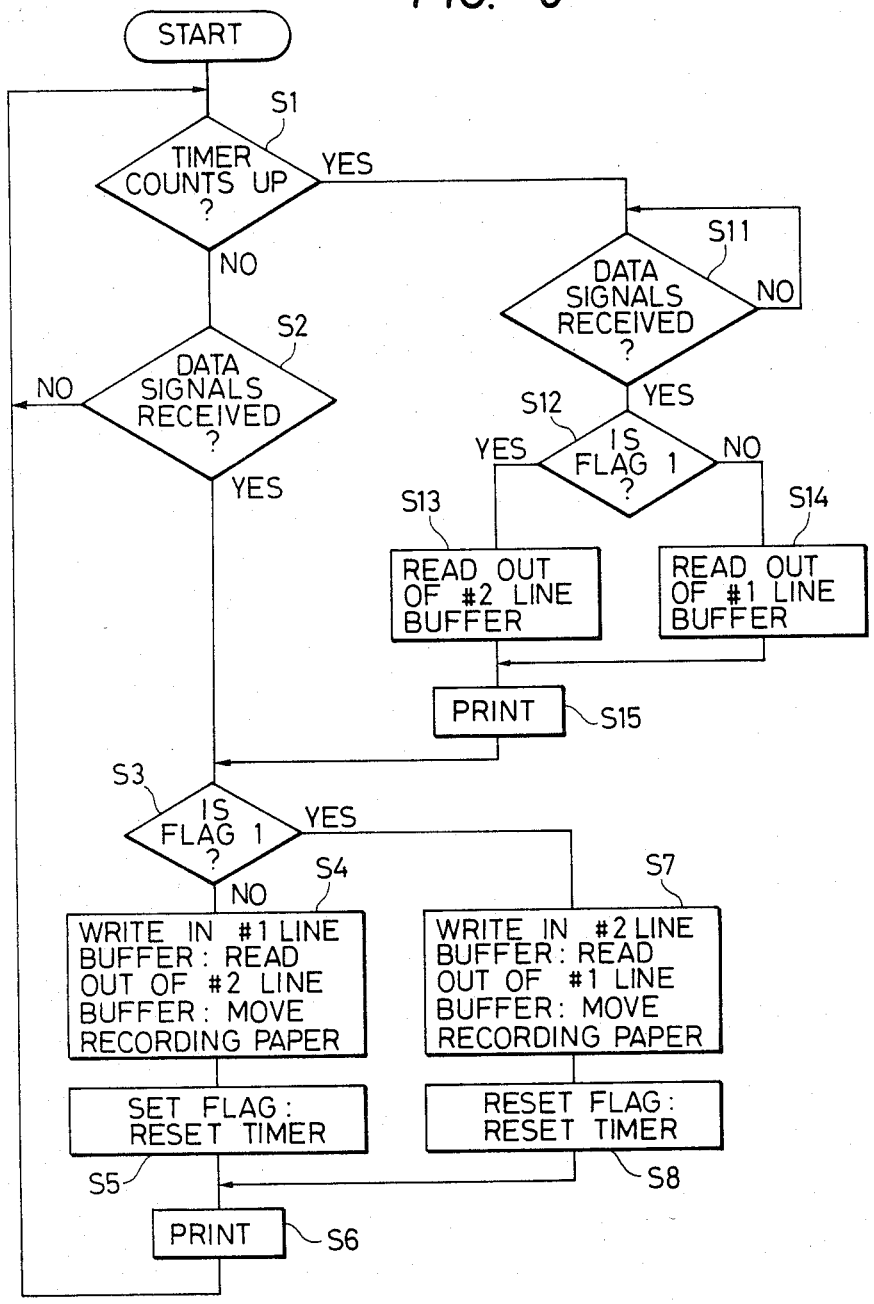
FIG. 8 is a flow chart of FIG. 6.

It is to be noted that Steps $S_{12}$, $S_{13}$, and $S_{14}$ may be omitted in respect of the example of FIG. 8, if the thermal head shown in FIGS. 1 and 3 is provided with a buffer circuit.

Namely, in this case, printing can be executed at Step $S_{11}$ after reception of data signal was detected without deciding a line buffer and reading out of information from the line buffer, because the preceding information for 1 line has been stored in the buffer circuit of the thermal head 5. In case of FIG. 8, continuous printing for 2 lines can also be attained by utilizing such data signal which was newly received, and it is, of course, clear that similar advantages to those mentioned above are obtained by this modification.

Furthermore, although a thermal recording paper is used as thermal recording medium in the present example, of course, the same advantages can also be obtained by the use of an ink donor sheet.

In addition, the present invention has been described hereinbefore with reference to a device wherein a thermal recording medium is travelled by means of a drive roll and a pinch roll, but the invention is not limited to such case as described above. More specifically, the same advantages can be attained also by means of a device wherein such thermal recording medium is travelled by driving a back roll with a motor.

In view of the above, the present invention has such an advantage that deterioration in picture quality due to appearance of a white space line produced on record can be prevented by a construction wherein either printing for 1 line of lastly recorded printing is again effected, or such printing for 1 line which was first received after the lapse of waiting time is continuously carried out twice in the case when the waiting time for information was over an expected period of time as described above.

What is claimed is:

1. A thermal recording device for recording on a thermal recording medium in response to recording data signals, the device comprising:

a thermal recording head and a back roll being disposed opposite to each other so as to sandwich a thermal recording medium therebetween wherein one line each of recording is effected after movement of said recording medium;

a timer for measuring an interval after recording of a certain one line was completed to produce an output at a time when an expected period of time elapses;

means for resetting said timer in response to an input of a recording data signal; and means for supplying a same data signal with that used in recording the certain one line effected immediately before a present recording to said thermal recording head in response to the output of said time, thereby to effect again a same printing with that of the certain one line recorded immediately before the present recording on said recording medium.

2. A thermal recording device for recording on a thermal recording medium in response to recording data signals, the device comprising:

a thermal recording head and a back roll being disposed opposite to eAch other so as to sandwich a thermal recording medium therebetween wherein one line each of recording is effected after movement of said recording medium;

a timer for measuring an interval after recording of a certain one line was completed to produce an output at a time when an expected period of time elapses;

means for resetting said timer in response to an input of a recording data signal; and means for supplying a same data signal with that of the certain one line whose recording was effected immediately before a present recording to said thermal recording head in response to the output of said timer as well as an input received of data signal for recording a following one line, thereby to effect again a same printing with that of the line recorded immediately before the present recording on said recording medium.

3. A thermal recording device for recording on a thermal recording medium in response to recording data signals, the device comprising:

a thermal recording head and a back roll being disposed opposite to each other so as to sandwich a thermal recording medium therebetween wherein one line each of recording is effected after movement of said recording medium;

a timer for measuring an interval after recording of a certain one line was completed to produce an output at a time when an expected period of time elapses;

means for resetting said timer in response to an input of a recording data signal; and means for additionally executing printing based on a data signal for recording a following one line in response to the output of said timer as well as an input received of said data signal for recording the following one line prior to normal recording for one line due to said data signal for recording the following one line.

4. A thermal recording device according to claim 1, wherein said thermal recording medium is a thermal recording paper.

5. A thermal recording device according to claim 1, wherein said thermal recording medium is a combination of an ink donor sheet and a plain paper.

6. A thermal recording device according to claim 2, wherein said thermal recording medium is a thermal recording paper.

7. A thermal recording device according to claim 2, wherein said thermal recording medium is a combination of an ink donor sheet and a plain paper.

8. A thermal recording device according to claim 3, wherein said thermal recording medium is a thermal recording paper.

9. A thermal recording device according to claim 3, wherein said thermal recording medium is a combination of an ink donor sheet and a plain paper.

* * * * *